US007017451B2

(12) United States Patent
Hsien

(10) Patent No.: US 7,017,451 B2
(45) Date of Patent: Mar. 28, 2006

(54) LOCKING STRUCTURE OF UNIDIRECTIONAL SPANNER

(76) Inventor: Chin-Ching Hsien, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/791,610

(22) Filed: Mar. 3, 2004

(65) Prior Publication Data

US 2005/0193871 A1 Sep. 8, 2005

(51) Int. Cl.
*B25B 13/46* (2006.01)

(52) U.S. Cl. ..... 81/60; 81/59.1; 192/45.1

(58) Field of Classification Search ..... 81/59.1, 81/60, 58.1, 58.2, 58.4, 63.1, 148; 192/45.1, 192/45

See application file for complete search history.

(56) References Cited

U.S. PATENT DOCUMENTS 810,599 A * 1/1906 Ansorge ..... 81/60
870,014 A * 11/1907 Campbell ..... 81/59.1
870,151 A * 11/1907 Rollin ..... 81/59.1
1,169,007 A * 1/1916 Chadwick ..... 81/59.1
2,487,987 A * 11/1949 Schmitt et al. ..... 81/59.1
3,577,816 A * 5/1971 Alexander et al. ..... 81/63.1
5,259,276 A * 11/1993 Baron ..... 81/59.1
5,417,129 A * 5/1995 Baron ..... 81/59.1

* cited by examiner

*Primary Examiner*—Hadi Shakeri

(57) ABSTRACT

A locking structure of a unidirectional spanner comprises a spanner body having a receiving chamber and at least one directional control communicated with the receiving chamber; a toothless ratchet receiving in the receiving chamber; at least one directional control device receiving in the directional control groove; the directional control device being formed by a directional control unit and an elastomer; the directional control unit being locked with the toothless ratchet. If the spanner body moves, a reverse force will apply to the toothless ratchet; when the reverse force causes the directional control unit to move away from the elastomer, the toothless ratchet will be locked by the directional control unit so that the toothless ratchet rotate synchronously with the spanner body. When the reverse force cause that the directional control unit can compress the elastomer, the toothless ratchet will rotate independently, namely, not rotate synchronously with the spanner body.

3 Claims, 6 Drawing Sheets

LOCKING STRUCTURE OF UNIDIRECTIONAL SPANNER

FIELD OF THE INVENTION

The present invention relates to spanners, and particularly to a locking structure of a unidirectional spanner.

BACKGROUND OF THE INVENTION

In the prior art ratchet spanner, the spanner includes a ratchet with teeth and a braking block. The braking block is engaged with the ratchet. A spring serves to latch the block so that the ratchet spanner rotates unidirectionally. However this prior art has completed manufacturing process. Especially the design of the teeth on the ratchet which wastes a larger amount of work. Thus, if the work of forming teeth can be negated, the cost will be reduced greatly and therefore, the price of the ratchet spanner will also be reduced.

In another prior art, a toothless ratchet is developed, but too many elements are used and thus the cost is also high. Thereby it is difficult to update the parts. Furthermore, the structure is not easy to make, such as a round hole is formed for receiving a spring, but this will make the manufacturing process complicated.

SUMMARY OF THE INVENTION

Accordingly, the primary object of the present invention is to provide a locking structure of a unidirectional spanner which comprises a spanner body having a receiving chamber and at least one directional control communicated with the receiving chamber; a toothless ratchet receiving in the receiving chamber; at least one directional control device receiving in the one directional control groove; the directional control device being formed by a directional control unit and an elastomer; the directional control unit being locked with the toothless ratchet. If the spanner body moves, a reverse force will apply to the toothless ratchet; when the reverse force causes the directional control unit to move away from the elastomer, the toothless ratchet will be locked by the directional control unit so that the toothless ratchet rotate synchronously with the spanner body. When the reverse force causes the directional control unit to compress the elastomer, the toothless ratchet will rotate independently, namely not rotate synchronously with the spanner body. The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
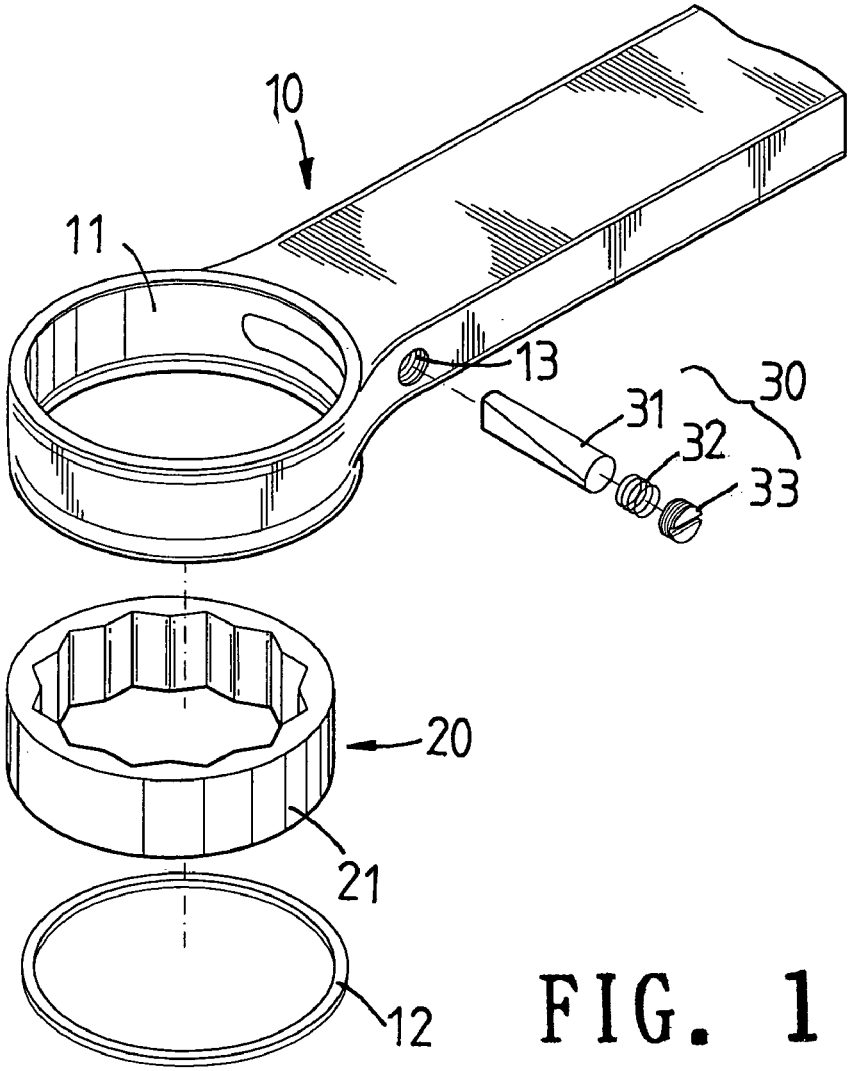
FIG. 1 is a structural exploded view of the locking structure of a unidirectional spanner of the present invention.
Figure 2:
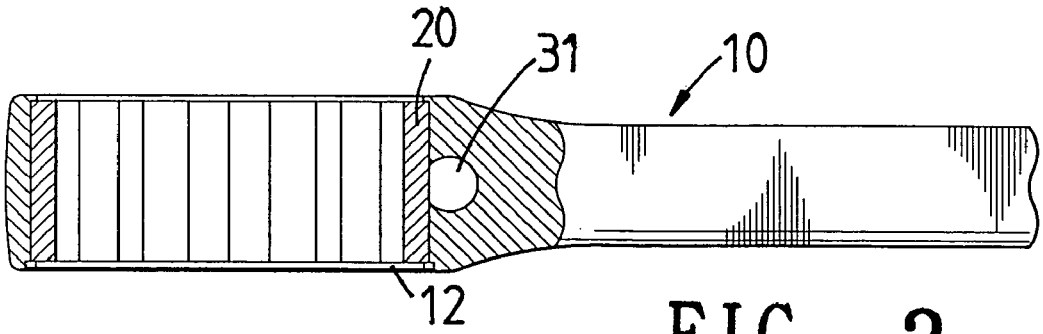
FIG. 2 is a cross sectional view of the locking structure of a unidirectional spanner of the present invention

With reference to FIGS. 1 and 2, the locking structure of a unidirectional spanner of the present invention is illustrated. The locking structure includes a spanner body 10, a toothless ratchet 20, and a directional control device 30.

One end of the spanner body 10 is formed with a receiving chamber 11. The receiving chamber 11 exactly receives the toothless ratchet 20. In assembly, a first sealing unit 12 is received at an inner periphery of the toothless ratchet 20. Then the toothless ratchet 20 is placed within the receiving chamber 11. Thereby the toothless ratchet 20 is buckled in the receiving chamber 11. A directional control groove 13 is formed aside the receiving chamber 11. The directional control groove 13 serves to receive the directional control device 30. The toothless ratchet 20 locks the directional control device 30.

The feature of the present invention will be described herein.

A cambered surface is defined at an outer periphery of the toothless ratchet at a predetermined position of the directional control device 30.

The directional control device 30 is formed by a directional control unit 31, an elastomer 32 and a second sealing unit 33 which are sequentially installed in the directional control groove 13. Then the second sealing unit 33 serves to seal the directional control device 30 within the directional control groove 13. The directional control device 30 is a cylinder. A lateral side of the cylinder is chamfered. The chamfered side exposes in the receiving chamber 11 and are tightly contact the round chamfered surface 21 of the toothless ratchet 20. The elastomer 32 resists against the directional control unit 31.

Figure 4:
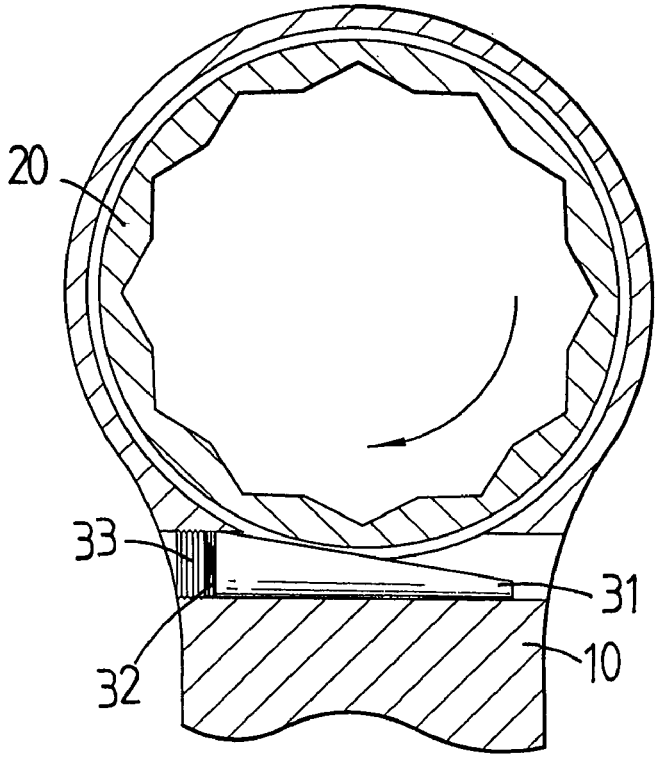
FIG. 4 shows the operation that the locking structure of a unidirectional spanner is moved counterclockwise according to the present invention.
Figure 3:
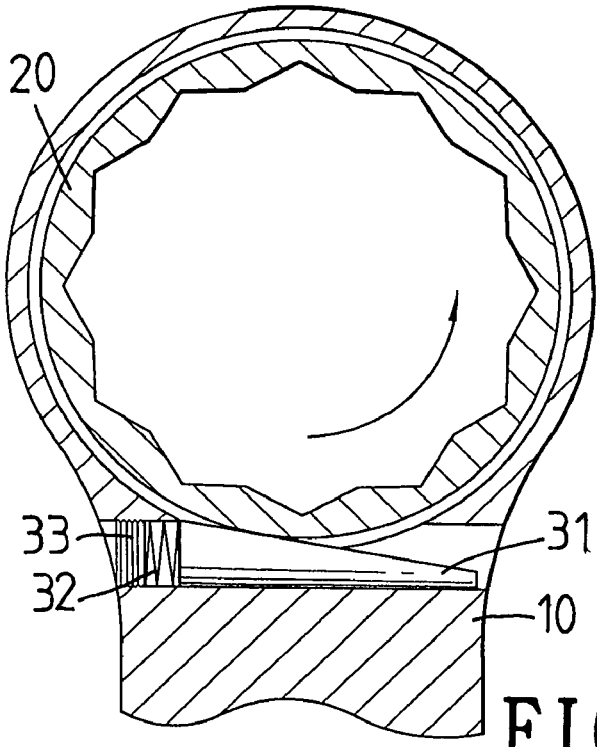
FIG. 3 shows the operation that the locking structure of a unidirectional spanner is moved clockwise according to the present invention.
Figure 5:
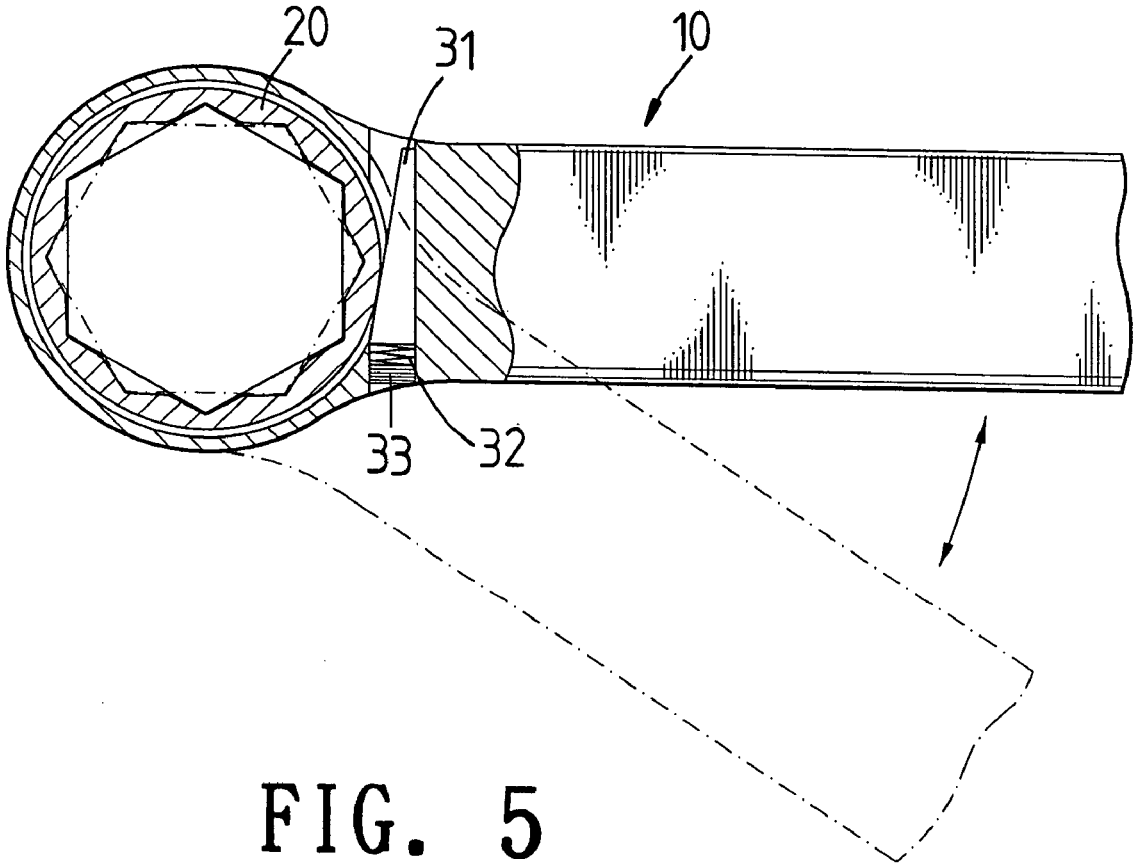
FIG. 5 shows a schematic view about the operation of the present invention.

With reference to FIGS. 3 to 5, in application, since the toothless ratchet 20 tightly contacts the directional control unit 31. When the spanner body 10 moves clockwise, the toothless ratchet 20 suffers from a counterclockwise force, but it is locked by the directional control unit 31 so as to rotate synchronously with the spanner body 10. Moreover, when the spanner body 10 is moved counterclockwise, the toothless ratchet 20 suffers from a clockwise stress. The stress provides a horizontal force component to the directional control unit 31. The elastomer 32 is compressed by the force, so that the directional control unit 31 moves horizontally. Thereby the toothless ratchet 20 may rotate the spanner body 10 to rotate.

Figure 6:
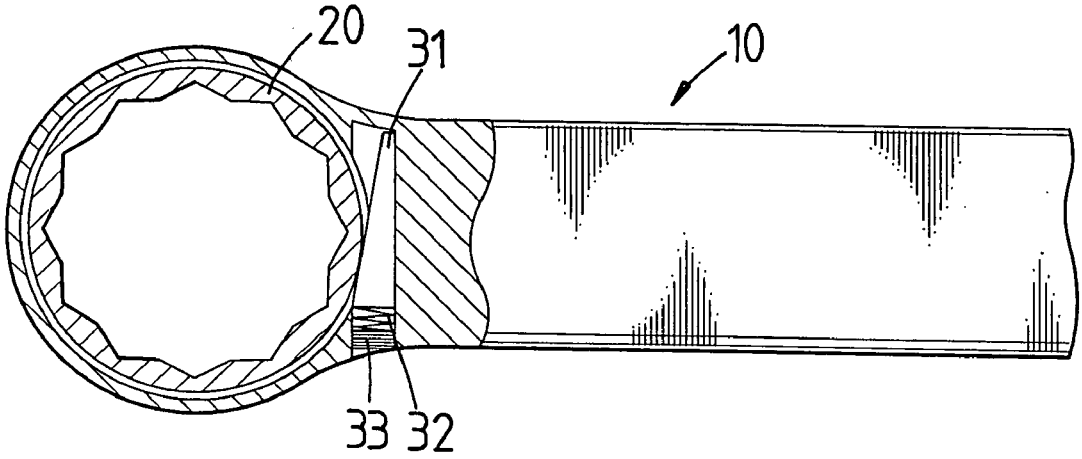
FIG. 6 is schematic view about the second embodiment of the locking structure of a unidirectional spanner according to the present invention.
Figure 7:
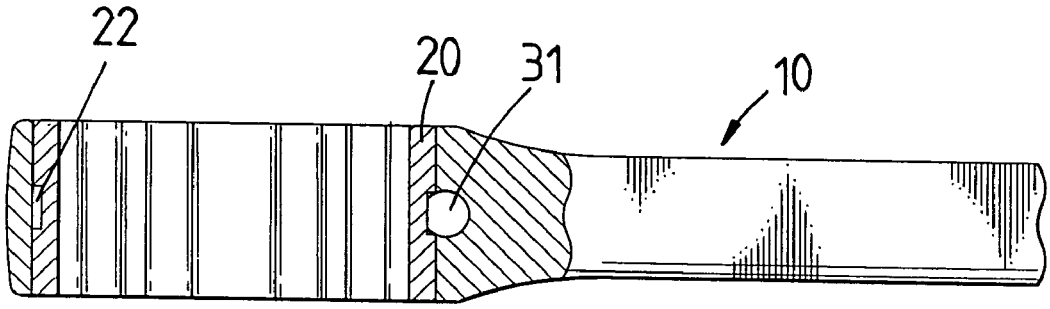
FIG. 7 is a cross sectional view of the second embodiment of the locking structure of a unidirectional spanner of the present invention.

The second preferred embodiment of the present invention will be described here with reference to FIGS. 6 and 7, the different of this second from the previous one is that an annular slot 22 is formed around the whole outer round periphery of the toothless ratchet 20. In this embodiment, the directional control unit 31 is located within the slot 22 to lock the toothless ratchet 20. The function and operation of the locking structure in this embodiment is same as above mentioned embodiment. Thus the detail will not be described further.

Figure 8:
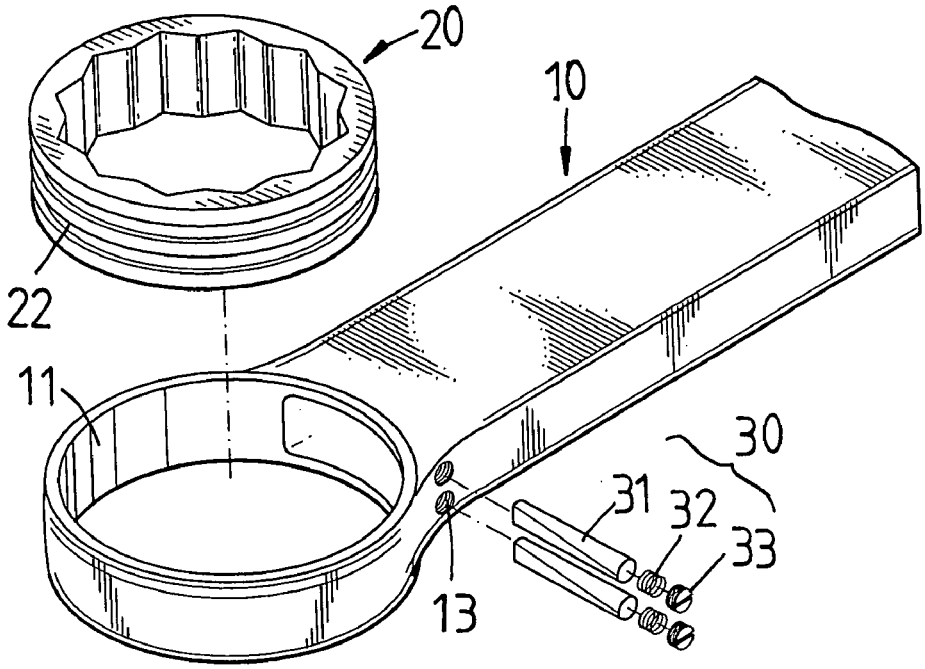
FIG. 8 is an exploded schematic view of the third embodiment of the locking structure of a unidirectional spanner according to the present invention.
Figure 9:
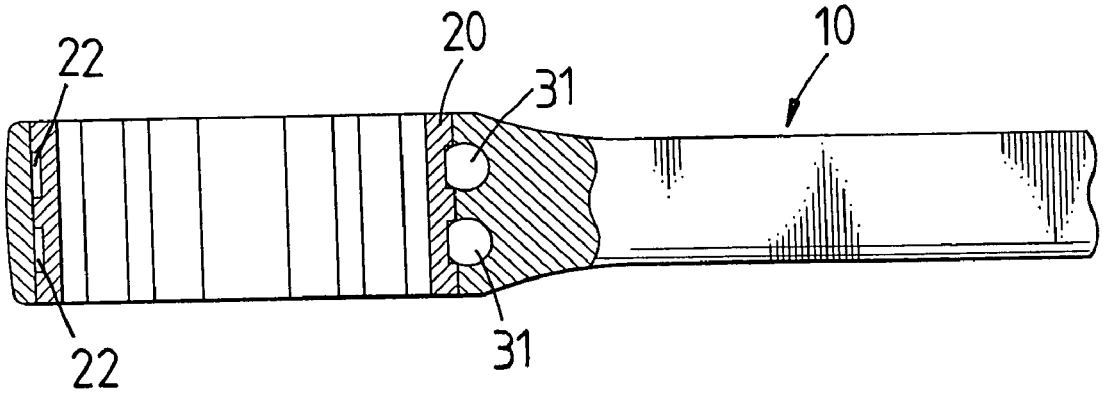
FIG. 9 is a cross sectional view about the third embodiment of the locking structure of a unidirectional spanner according to the present invention.

Referring to FIGS. 8 and 9, the third embodiment of the present invention is illustrated. The difference of this embodiment from above embodiments is that two directional control grooves 13 are formed and two directional control units 31 are installed. Thereby two annular slots 22 are formed around the whole outer round periphery of the toothless ratchet 20. The function and operation of the locking structure in this embodiment is same as above mentioned embodiment. Thus the detail will not be described further.

Figure 10:
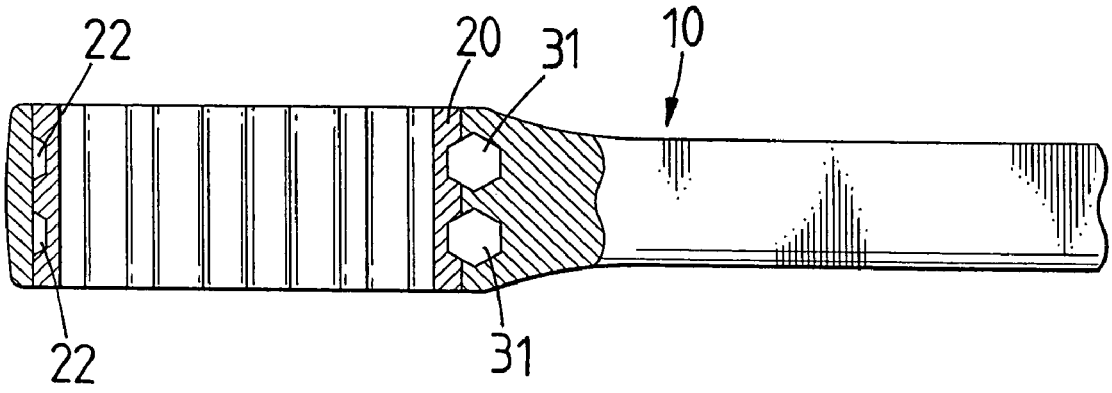
FIG. 10 is a schematic view about the fourth embodiment of the locking structure of a unidirectional spanner of the present invention.

Referring to FIG. 10, the fourth embodiment of the present invention is illustrated. The difference of this embodiment from the third embodiment is that the directional control units 31 has a hexagonal shape and the slots 22 have shapes corresponding to the directional control units 31. The function and operation of the locking structure in this embodiment is same as above mentioned embodiment. Thus the detail will not be described further.

Figure 11:
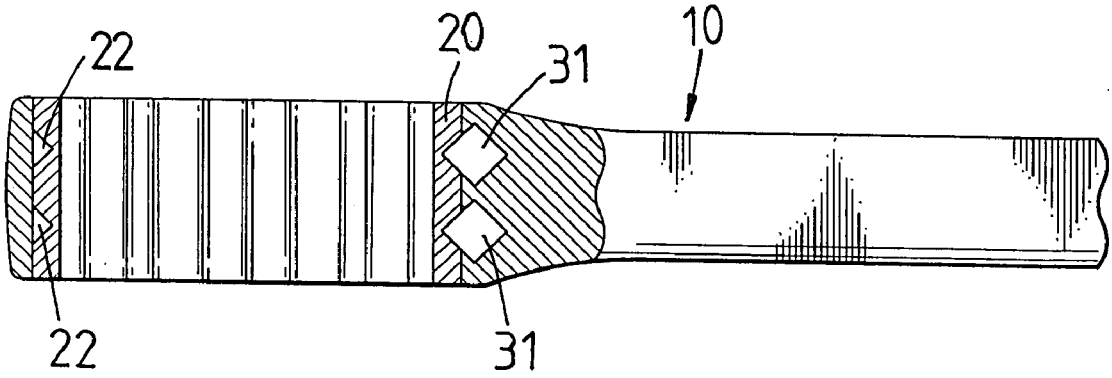
FIG. 11 is a schematic view about the fifth embodiment of the locking structure of a unidirectional spanner according to the present invention.

Referring to FIG. 11, the fourth embodiment of the present invention is illustrated. The difference of this embodiment from the third embodiment is that the directional control units 31 has a rectangular shape and the slots 22 have shapes corresponding to the directional control units 31. The function and operation of the locking structure in this embodiment is same as above mentioned embodiment. Thus the detail will not be described further.

Thereby, from above mentioned structures, it is shown that the present invention has improved the defects in the prior art. Moreover, the present invention has the following advantages. The direction of the spanner is controllable. When it is desired to update parts of the spanner, it is only necessary to release the second sealing unit 33, and then the elastomer or other parts can be updated easily. The present invention can be assembled easily. By the coupling of the toothless ratchet 20 and the directional control unit 31, in the present invention, no tooth is formed on the ratchet. The directional control unit 31 is formed by chamfered a surface in a simple shape and structure so that the manufacturing cost is reduced and the defect of having the process of making teeth on the ratchet is avoided in the present invention.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A locking structure of a unidirectional spanner comprising:

a spanner body having a receiving chamber at one end thereof and two directional control grooves aside the receiving chamber and communicated with the receiving chamber;

a toothless ratchet receiving in the receiving chamber; and outer periphery of the ratchet having two annular trenches;

two directional control devices receiving in the two directional control grooves; respectively; each of the directional control devices being formed by a directional control unit and an elastomer; the directional control unit locking the toothless ratchet;

wherein each directional control groove has an opening facing to a center portion of the receiving chamber; a part of each directional control device is protruded from the opening of the directional control groove to contact the ratchet and received into a respect one of the two annular trenches of the ratchet;

wherein if the spanner body moves, a reverse force will apply to the toothless ratchet; when the reverse force causes the directional control unit to move away from the elastomer, the toothless ratchet will be locked by the directional control unit so that the toothless ratchet rotates synchronously with the spanner body; when the reverse force causes the directional control unit to compress the elastomer, the toothless ratchet will rotate independently; and wherein each directional control unit is a rectangular cylinder; and a corner of each rectangular cylinder is faced to the receiving chamber.

2. A locking structure of a unidirectional spanner comprising:

a spanner body having a receiving chamber at one end thereof and two directional control grooves aside the receiving chamber and communicated with the receiving chamber;

a toothless ratchet receiving in the receiving chamber; and outer periphery of the ratchet having two annular trenches;

two directional control devices receiving in the two directional control grooves; each of the directional control devices being formed by a directional control unit and an elastomer; the directional control unit locking the toothless ratchet;

wherein each directional control groove has an opening facing to a center portion of the receiving chamber; a part of each directional control device is protruded from the opening of the directional control groove to contact the ratchet and received into a respect one of the two annular trenches of the ratchet;

wherein if the spanner body moves, a reverse force will apply to the toothless ratchet; when the reverse force causes the directional control unit to move away from the elastomer, the toothless ratchet will be locked by the directional control unit so that the toothless ratchet rotate synchronously with the spanner body; when the reverse force causes the directional control unit to compress the elastomer, the toothless ratchet will rotate independently; and wherein each directional control unit is a hexagonal cylinder.

3. A locking structure of a unidirectional spanner comprising:

a spanner body having a receiving chamber at one end thereof and two directional control grooves aside the receiving chamber and communicated with the receiving chamber;

a toothless ratchet receiving in the receiving chamber; and outer periphery of the ratchet having two annular trenches;

two directional control devices receiving in the two directional control grooves; each of the at least directional control device being formed by a directional control unit and an elastomer; the directional control unit locking the toothless ratchet;

wherein each directional control groove has an opening facing to a center portion of the receiving chamber; a part of each directional control device is protruded from the opening of the directional control groove to contact the ratchet and received into a respect one of the two annular trenches of the ratchet;

wherein if the spanner body moves, a reverse force will apply to the toothless ratchet; when the reverse force causes the directional control unit to move away from the elastomer, the toothless ratchet will be locked by the directional control unit so that the toothless ratchet rotates synchronously with the spanner body; when the reverse force causes the directional control unit to compress the elastomer, the toothless ratchet will rotate independently; and wherein each directional control unit is a cylinder having a round cross section and having a chamfered surface; and a normal line of the surface is tilt from a normal line of the round cross section.

* * * * *